United States Patent [19]

Ditzenberger

[11] 4,376,044

[45] Mar. 8, 1983

[54] AUTOMATIC SIZING DEVICE

[75] Inventor: Doyle Ditzenberger, Rockwell City, Iowa

[73] Assignee: Butler Manufacturing Company, Kansas City, Mo.

[21] Appl. No.: 287,881

[22] Filed: Jul. 29, 1981

[51] Int. Cl.[3] ..... B07B 1/00

[52] U.S. Cl. ..... 209/234; 209/267; 209/283; 209/355; 209/389

[58] Field of Search ..... 209/283, 311, 314, 267, 209/353, 355, 358, 234, 315, 356, 389

[56] References Cited

U.S. PATENT DOCUMENTS

| | | | |
|---|---|---|---|
| 262,405 | 8/1882 | Green | 209/267 X |
| 293,039 | 2/1884 | King | 209/267 |
| 653,363 | 7/1900 | Parker | 209/358 X |
| 1,870,629 | 8/1932 | Ingraham | 209/267 |
| 2,126,018 | 8/1938 | Kalkhoff | 209/267 X |
| 2,148,184 | 2/1939 | Baker | 209/283 X |
| 2,970,693 | 2/1961 | Morris | 209/314 X |
| 3,752,315 | 8/1973 | Hubach | 209/267 X |
| 4,035,993 | 7/1977 | Bell | 209/283 X |
| 4,115,257 | 9/1978 | Mugler | 209/267 X |

*Primary Examiner*—Ralph J. Hill

*Attorney, Agent, or Firm*—G. Brian Pingel

[57] ABSTRACT

An automatic sizing device for particulate or granular material containing small, medium and large sized particles flowing therethrough. The device includes an inclined housing with a first conduit having an inlet opening for receipt of the particulate material, and a second conduit that is located beneath the first conduit and has an outlet for the exit of medium sized particles from the housing. A first mesh sizing screen is longitudinally extended between the inlet and the outlet openings to divide the housing into the first and second conduits and includes a plurality of openings sized to permit passage of only medium and small sized particles therethrough. At least one metering rotor is located in the first conduit adjacent the sizing screen to retard the flow of particulate material through the first conduit and urge the medium and small sized particles to pass through the sizing screen into the second conduit. The housing may also include a third conduit defined by a second mesh sizing screen located beneath the first sizing screen and having openings sized to permit passage of only small sized particles therethrough for removal of small particles from the medium sized particles in the second conduit.

5 Claims, 5 Drawing Figures

AUTOMATIC SIZING DEVICE

BACKGROUND OF THE INVENTION

1. Field of the Invention

The present invention relates in general to automatic sizing devices for particulate or granular material and more specifically to such devices that include mesh sizing screens for separating various sized particles from one another.

2. Description of the Prior Art

Foreign matter in grain may comprise a substantial portion of the grain volume. For example, the amount of foreign matter in dry corn may be as much as 12% to 15% by weight. It is obviously desirable to remove this foreign matter from the grain in order to provide a more salable product. In addition, removal of foreign matter decreases grain freight costs because the volume of foreign matter removed will be replaced by grain, thereby resulting in more grain per cubic foot being shipped, an important economic factor when considering shipping costs and storage costs.

Foreign matter found in grain can be either material which is larger than the kernel, commonly referred to as "overs," or material smaller than the kernel, such as broken kernels, weed seed, sand, dirt, and dust, commonly referred to as "thru's." Numerous devices have been successfully used for eliminating "thru's" from the grain but there are few known devices for successfully removing "overs." However, due to certain shipping requirements, it is becoming increasingly important to remove the "overs" from grain. One such requirement is that corn shipped into the State of California must be passed over a one-half inch opening screen for removal of "overs" so that the corn qualifies for a European Corn Borer Certificate.

In the past, the removal of "overs," such as cobs, rocks, and husks has been accomplished by using a vibrating machine or a shaker device. However, such devices have an inherent deficiency in that they may be harmful to the concrete structures in which they are housed over long periods of time due to harmonic vibrations they produce. The present invention entirely eliminates the need for such shaking or vibrating operation and is much more economically constructed than prior art devices.

SUMMARY OF THE INVENTION

The present invention provides an automatic sizing device for particulate or granular material such as grain having large, medium and small sized particles therein. The sizing device is formed of an inclined housing having at least first and second conduit means, an upper inlet opening for receiving said particulate material in the upper end of the first conduit means, and at least one lower outlet opening for the exit of at least the medium sized particles from the lower end of said second conduit means. Sizing means are located within the housing and include a first mesh sizing screen longitudinally extended between the inlet opening and the outlet opening to divide the housing into said first and second conduit means.

The first sizing screen includes a plurality of openings sized to permit passage of only medium and small sized particles therethrough. Positioned in a closely adjacent relationship to the upper surface of the first sizing screen is a retarding means that serves to retard the flow of said particulate material through the first conduit means. In this way, the particulate material is urged against the upper surface of the first sizing screen to induce the medium and small sized particles to pass through said screen into the second conduit means and exit from the outlet opening.

Preferably the sizing means further includes a second mesh sizing screen disposed inside the housing in position beneath the first sizing screen and spaced apart therefrom to define the top of a third conduit means whereby the particles falling through the first sizing screen will drop onto the second sizing screen. The second sizing screen has openings therethrough of a proper dimension to permit passage of only small sized particles therethrough whereby the small particles are removed from the medium sized particles and flow into the third conduit means.

The retarding means preferably is comprised of a pair of metering rotors positioned in series transversely to the first sizing screen. Formed in such screen are two concave shaped reservoir troughs aligned with the metering rotors in such fashion that the vanes of each rotor sweep across the periphery of its associated trough. The rotors turn at a relatively slow speed to remove the particulate material that is not passed through the first sizing screen from the reservoir troughs to continue flow through said first conduit means.

DESCRIPTION OF THE PREFERRED EMBODIMENT

Figure 1:
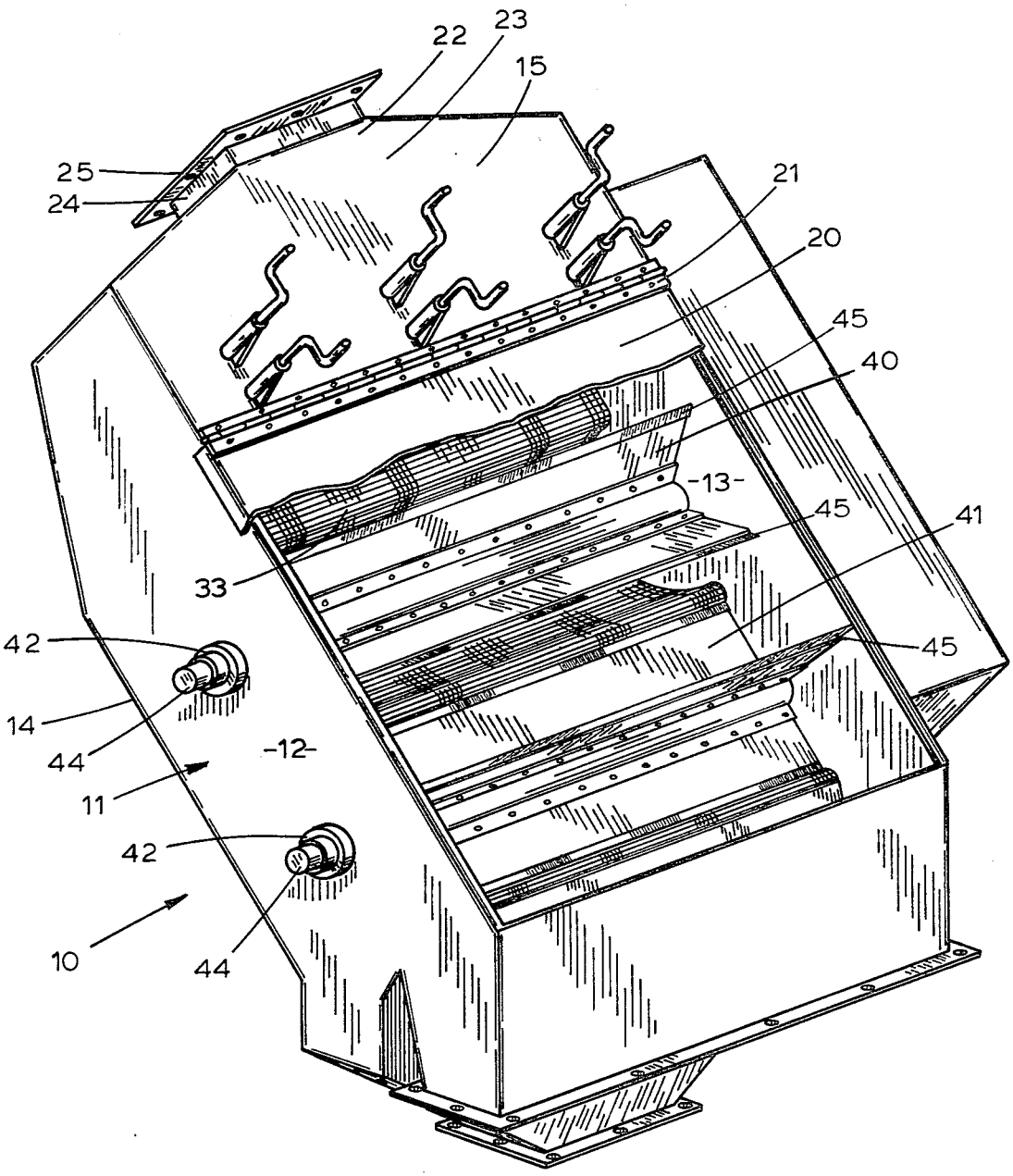
FIG. 1 is a front perspective view of the automatic sizing device of the present invention with portions cut away to expose interior construction.

A preferred embodiment of the automatic sizing device of the present invention is shown at 10 in FIG. 1. This embodiment is particularly useful as an agricultural grain cleaner but those skilled in the art will readily recognize that the sizing device 10 may be advantageously employed in a wide variety of other applications as well.

The sizing device 10 has a generally inclined housing 11 having side walls 12 and 13 joined together by a bottom wall 14 and a top wall section 15 that covers only an upper end portion of the housing 11. The remainder of the top surface of the housing 11 is provided by a lid 20 that is hinged to the top wall section 15 at 21 to provide ready access to the interior of the housing 11.

Figure 2:
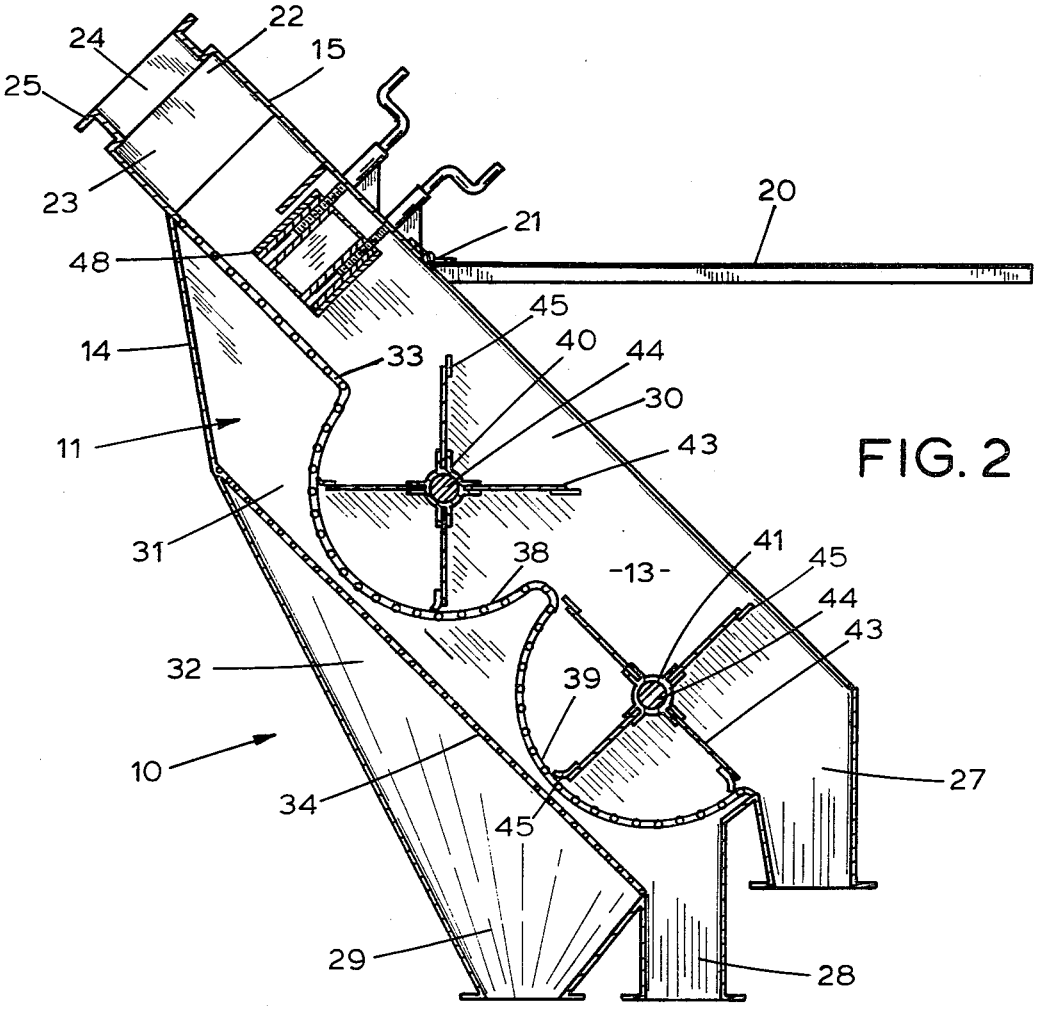
FIG. 2 is a sectional view of the device of FIG. 1 taken along the line 2—2.

Referring now also to FIG. 2, an upper end 22 of the housing 11 is closed off by a cap portion 23 having a necked inlet 24. A circumferential flange 25 is formed on the inlet 24 for attachment to a spout (not shown) that serves as a means for supplying material to the device 10. The bottom end of the housing 11, as shown most fully in FIG. 2, terminates in three downwardly directed spouts 27, 28 and 29 that serve as exit ports from the housing 11, as will be described in detail below.

Figure 3:
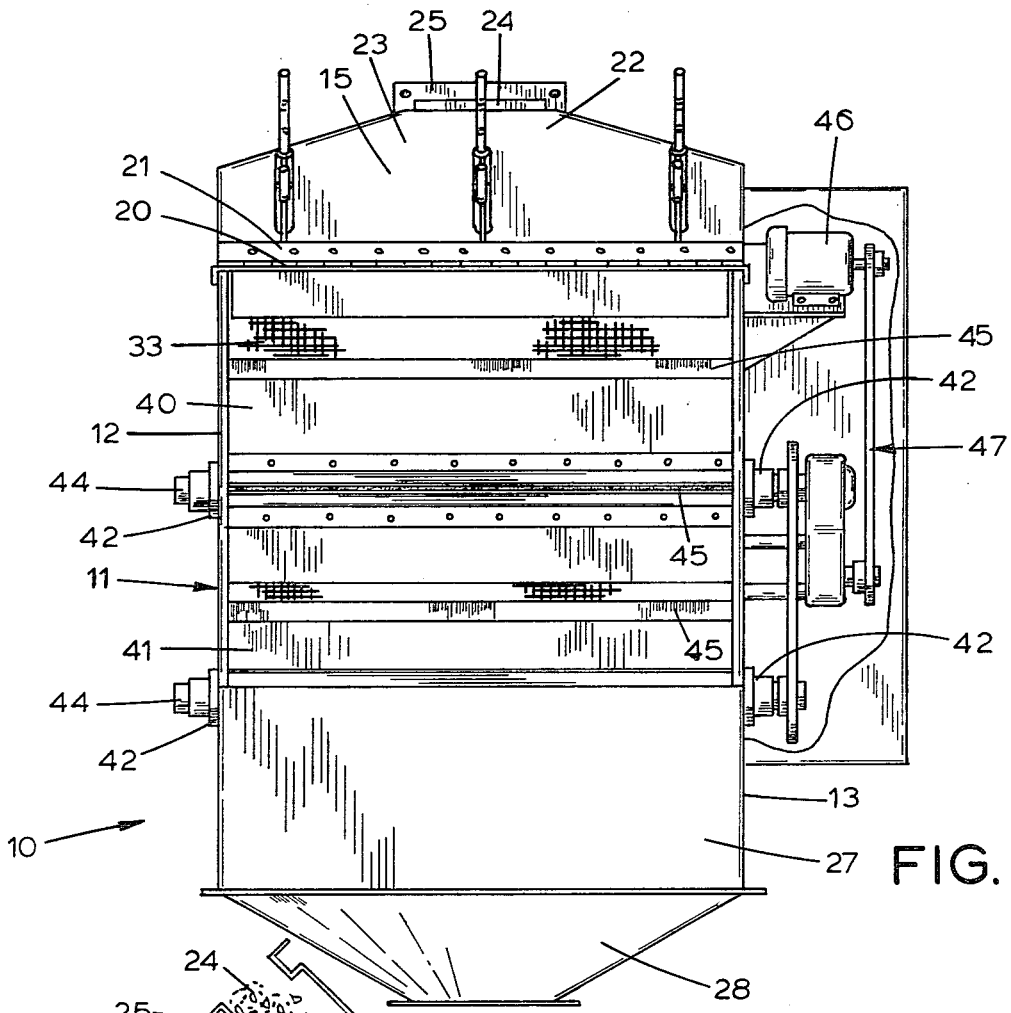
FIG. 3 is a front view in elevation of the device of FIG. 1.

Turning now to the interior construction of the device 10, the housing 11 is divided into three conduits 30, 31 and 32, by two longitudinally positioned, spaced apart mesh screens 33 and 34 that are preferably parallel to one another. The screen 33 extends from the bottom edge of the inlet 24 to the top edge of the exit spout 28 and is formed with two transversely extended concave shaped troughs 38 and 39 arranged in series relation with one another. Rotors 40 and 41 are journaled at 42 (see FIG. 1) in the housing side walls 12 and 13 and have vane members 43 that sweep across the periphery of the troughs 38 and 39, respectively. Thus, axles 44 of the rotors 40 and 41 are positioned respectively along the axis of imaginary cylinders of which the troughs 38 and 39 are arc sections. Preferably, the vane members 42 terminate in flexible extensions 45 that contact the screen 33. It has been found desirable that at least one of these extensions 45 on each rotor 40 and 41 should be a cleaning brush and the other extensions should be agitators that project from the vane members 43 and are adjustable in the extent of their projection to keep the "overs" from jamming between the vane members 43 and the upper surface of the screen 33. The rotors 40 and 41 are driven in counterclockwise direction, as viewed in FIG. 2, at a relatively low speed (3 to 25 rpm) by preferably an electric motor 46 (see FIG. 3) through a belt and sprocket drive train 47.

Figure 4:
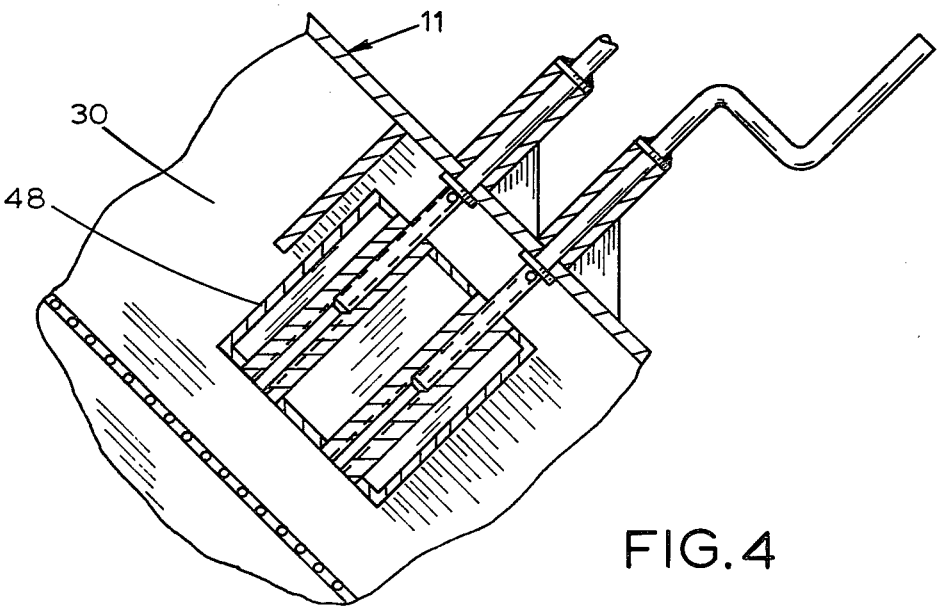
FIG. 4 is an enlarged view of the upper end of the device of FIG. 1.

In a cleaning operation of the device 10 for removal of foreigh matter (overs) from grain, the grain with its entrained foreign matter is fed into the housing 11 via the inlet 24 and into the conduit 30. Referring to FIG. 4, an adjustable leveling plow 48 is located in the top portion of the conduit 30 to permit a uniform layer of grain and foreign matter to flow into the remainder of the conduit 30 along the upper surface of the screen 33.

The mesh screen 33 has openings of the proper dimension to permit the passage of the grain and small sized foreign material (thru's) therethrough. However, as the grain with its entrained foreign matter enters the conduit 30, its speed of travel causes the majority of the grain and foreign materials to skip along the surface of the screen 33 rather than falling therethrough, similar to the action of a flat rock that ricochets along the surface of a pond. The rotors 40 and 41 and their respective troughs 38 and 39 prevent such skipping action from occurring by acting as metering means to substantially reduce the speed of the grain and foreign materials flowing through the conduit 30.

Figure 5:
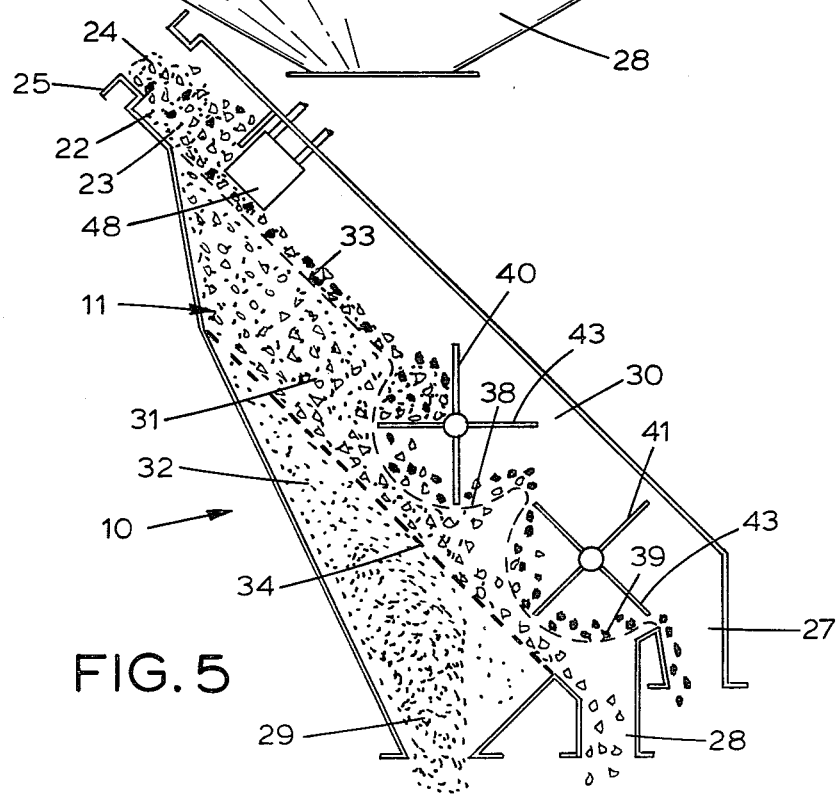
FIG. 5 is a diagrammatic view similar to that of FIG. 2 but showing particulate materials passing through said device and being separated therein.

Referring to FIG. 5, after the grain and foreign materials pass under the leveling plow 48, they travel along the screen 33 until encountering the first metering rotor 40, at which time they are swept about the periphery of the trough 38 by the rotor vanes 43.

As previously described, the rotors 40 and 41 revolve at a relatively slow speed (3 to 25 rpm) so that a large majority of the grain and "thru's" in the material will drop through the screen 33 into the conduit 31 therebeneath. The "overs" and a small amount of grain and "thru's" still remaining are then swept out of the trough 38 to continue their flow down the conduit 30 and into the second trough 39 where a similar sweeping action is provided by the rotor 41. In this way, essentially all the grain that was in the original material entering the conduit 30 is passed through the screen 33 and all that remains to be swept out of the trough 39 are the "overs" which are then discharged from the device 10 through the exit spout 27.

Because there is only a small amount of grain left in the conduit 30 below the rotor 40, it is not essential that the device 10 include the second rotor 41 and trough 39. However, for optimum cleaning operation and to insure that essentially no grain is lost during such operation, it is highly preferable to employ such components.

The grain and "thru's" that drop through the screen 33 enter the conduit 31 and are supported therein by mesh screen 34 to resume their downward travel through the device 10. However, the screen 34 has openings of the proper dimension to permit the passage therethrough of the "thru's" associated with the grain. At this point, the grain is not moving at a high rate of speed and consequently little, if any skipping action of the grain and entrained "thru's" occur. Thus, the "thru's" filter through the screen 34 to enter into the conduit 32 for discharge through the exit spout 29. As a result, by the time the grain reaches the bottom end of the conduit 31 for discharge through the exit spout 28, essentially all of the "overs" and "thru's" have been removed therefrom.

It can, therefore, be seen that the present invention provides a highly efficient sizing operation for particulate or granular material and yet does so with smooth and controlled operation that applies substantially no damaging stresses on the structure in which it is contained. Although the preferred embodiment 10 has been described as providing removal of both "overs" and "thru's" from grain, those skilled in the art will recognize that there are various other efficient methods of removing "thru's" from grain and that it is, therefore, not essential to employ the screen 34 in the device 10 for this purpose. Accordingly, the use of the screen 34 is not essential to the present invention but is highly preferred.

Although a preferred embodiment has been shown and described herein, it should be understood that many modifications could be made in such embodiment without departing from the true spirit and scope of the present invention. The length of the arc of the troughs 38 and 39 and its relationship to the rotor vanes 43 may vary from application to application. Furthermore, the primary angle on which the entire device 10 is positioned during installation may also be varied depending upon the flowability of the material being sized and separated. It may also be advantageous to incorporate structure which will enable the device 10 to be adjusted to change the attitude of either the inlet or outlet ends thereof.

What is claimed is:

1. An automatic sizing device for particulate or granular material flowing therethrough containing at least large and medium sized particles, said sizing device comprising:

(a) an inclined housing having first and second conduit means, an inlet opening for receiving said material in one end of said first conduit means, and at least one lower outlet opening for exit of said medium sized particles from an opposite end of said second conduit means;

(b) a first inclined stationary sizing means to divide said housing into said first and second conduit means and having a plurality of openings between said first and second conduit means sized to permit passage of said medium sized particles therethrough;

(c) a first retarding means in said first conduit means and associated with said first sizing means to retard the flow of said material through said first conduit means thereby urging said material against the upper surface of said first sizing means whereby said medium sized particles pass through said sizing means into said second conduit means and exit from said outlet opening;

(d) said first sizing means is formed with a first transversely extended trough adjacent to said retarding means; and (e) said first retarding means is transversely extended across said sizing means and is in the form of a rotatably driven rotor having at least one vane for sweeping said material that has not passed through said sizing means out of said first trough to continue its flow in said first conduit means.

2. An automatic sizing device as recited in claim 1, wherein said material includes small sized particles and said device further includes a second stationary sizing means that is below and generally parallel to said first sizing means and spaced apart therefrom to define a third conduit means and having a plurality of openings between said second and third conduit means sized to permit passage of only small sized particles therethrough.

3. An automatic sizing device as recited in claim 2 wherein said troughs of said first and second sizing means are concave shaped.

4. An automatic sizing device as recited in claim 1, wherein said first sizing means is extended between the bottom of said inlet opening and the top of said outlet opening.

5. An automatic sizing device as recited in claim 1, wherein said device further includes:

(a) a second retarding means transversely extended across said sizing means intermediate said first retarding means and said lower outlet and rotatable with respect to said sizing means to further retard the flow of said material through said first conduit means;

(b) said first sizing means is formed with a second transversely extended trough spaced apart from said first trough and adjacent to said second retarding means; and (c) said second retarding means has at least one vane for sweeping said material that is not passed through said first sizing means out of said second trough to continue its flow in said first conduit means.

* * * * *